US006293337B1

(12) United States Patent
Strähle et al.

(10) Patent No.: US 6,293,337 B1
(45) Date of Patent: Sep. 25, 2001

(54) EXHAUST GAS HEAT EXCHANGER

(75) Inventors: Roland Strähle, Unterensingen; Wolfgang Knecht, Stuttgart; Viktor Brost, Aichtal, all of (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/360,216

(22) Filed: Jul. 23, 1999

(30) Foreign Application Priority Data

Jul. 24, 1998 (DE) ..... 198 33 338

(51) Int. Cl.[7] ..... F28F 3/00
(52) U.S. Cl. ..... 165/166; 165/165
(58) Field of Search ..... 165/148, 166, 165/165, 164

(56) References Cited

U.S. PATENT DOCUMENTS

| | | | | |
|---|---|---|---|---|
| 2,566,310 | * | 9/1951 | Burns et al. | 165/166 X |
| 3,165,152 | * | 1/1965 | Jones | 165/166 |
| 3,289,757 | * | 12/1966 | Rutledge | 165/166 |
| 3,460,611 | * | 8/1969 | Folsom et al. | 165/166 |
| 3,797,565 | * | 3/1974 | Fernandes | 165/166 X |
| 4,029,146 | * | 6/1977 | Hart et al. | 165/166 |
| 4,276,927 | * | 7/1981 | Foust | 165/166 X |
| 4,386,651 | * | 6/1983 | Reinhard | 165/166 X |
| 4,475,589 | * | 10/1984 | Mizuno et al. | 165/166 |
| 4,688,631 | * | 8/1987 | Peze et al. | 165/166 |
| 5,803,162 | | 9/1998 | Karbach et al. . | |

FOREIGN PATENT DOCUMENTS

| | | | | |
|---|---|---|---|---|
| 692015 | * | 8/1964 | (CA) | 165/166 |
| 1105894 | * | 5/1961 | (DE) | 165/165 |
| 3124918 | | 2/1983 | (DE) . | |
| 8319866 | | 12/1983 | (DE) . | |
| 29616354 | | 1/1997 | (DE) . | |
| 0245022 | | 11/1987 | (EP) . | |
| 0677715 | | 4/1995 | (EP) . | |
| 610441 | * | 9/1926 | (FR) | 165/166 |
| 293759 | * | 11/1928 | (GB) | 165/166 |
| 938088 | * | 9/1963 | (GB) | 165/166 |

* cited by examiner

*Primary Examiner*—Leonard Leo
(74) *Attorney, Agent, or Firm*—Wood, Phillips, VanSanten, Clark & Mortimer

(57) ABSTRACT

An exhaust gas heat exchanger including a stack of heat exchanger plates that form separate flow channels that run parallel to each other, collection spaces, and inlets and outlets for the exhaust gas and for the preferably liquid coolant. The flow channels for the one of the media formed from heat exchanger plates are longer than the flow channels for the other medium, and pass through the collection space for this other medium. The heat exchanger also includes a region without a housing in which the two flow channels run parallel to each other.

1 Claim, 4 Drawing Sheets

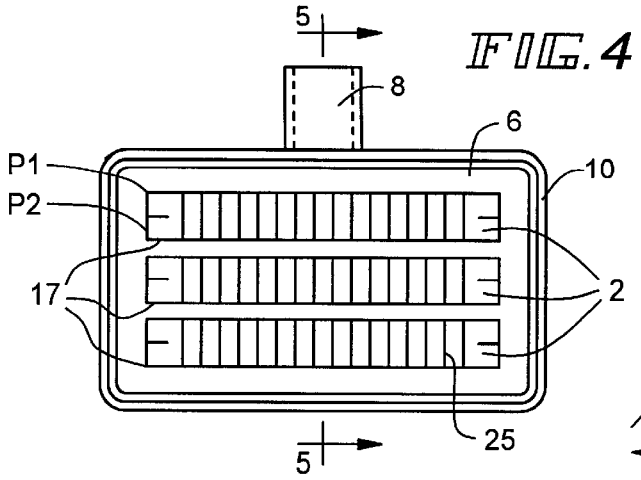
FIG. 4
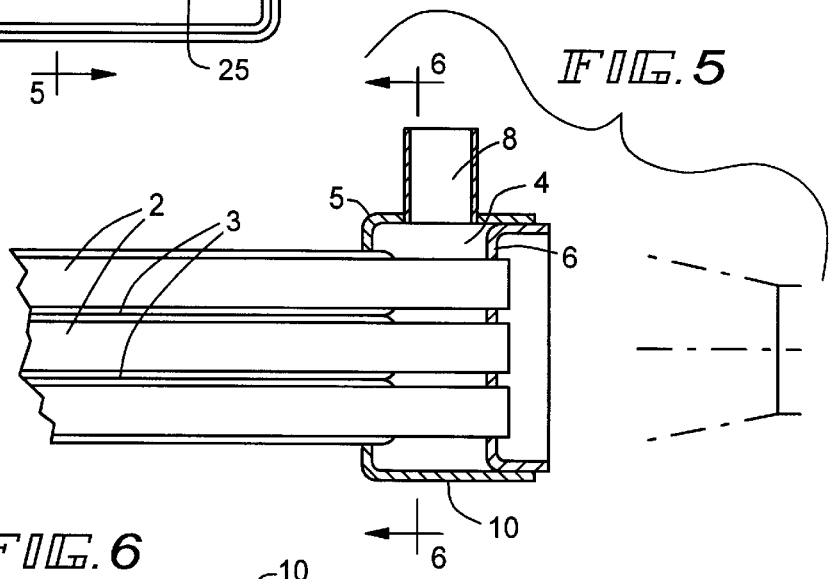
FIG. 5
FIG. 6
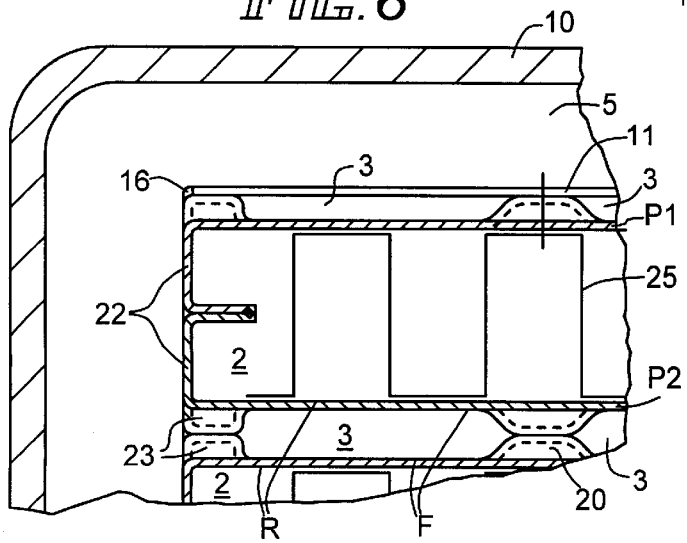
FIG. 7
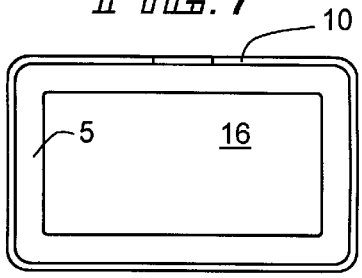

FIG. 9
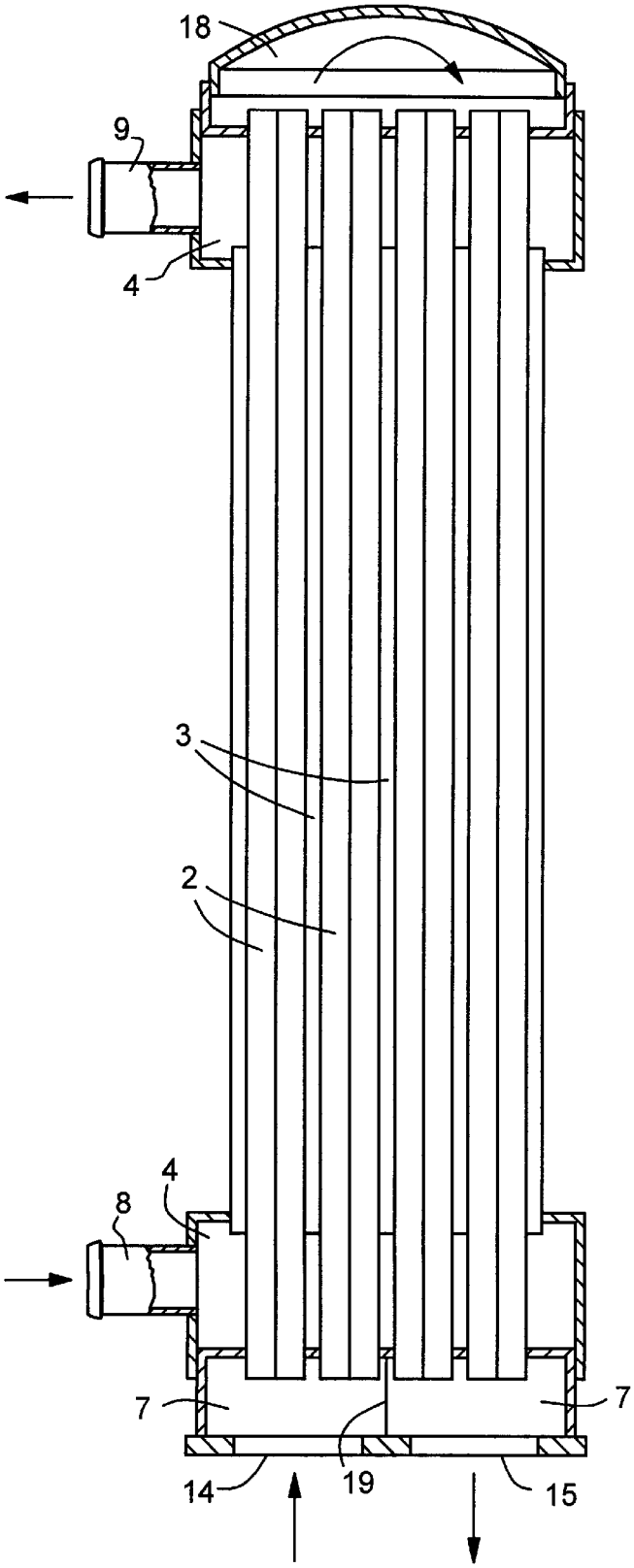
FIG. 8
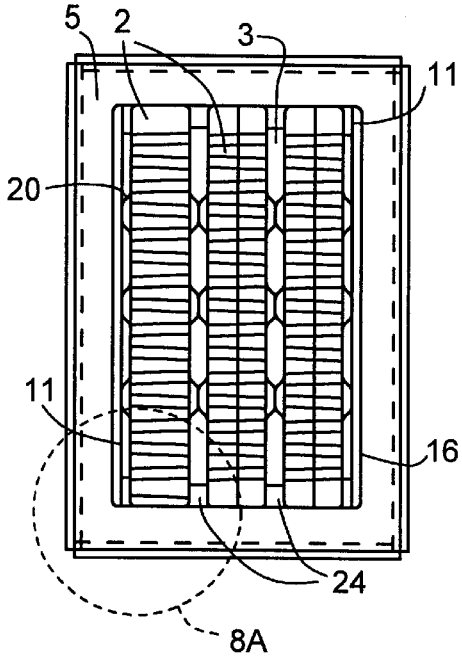
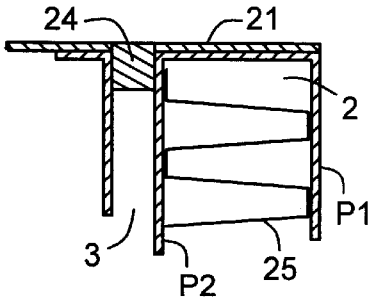
FIG. 8A

EXHAUST GAS HEAT EXCHANGER

FIELD OF THE INVENTION

The present invention is directed to a heat exchanger, and in particular to an exhaust gas heat exchanger including a stack of heat exchanger plates that define separate parallel flow channels.

BACKGROUND OF THE INVENTION

In the early 1980s, the typical exhaust gas heat exchangers were the so-called tube bundle heat exchangers, which consist of a bundle of round tubes that are connected at both ends to tube sheets to pass fluid therethrough. See, for example, German Utility Patent No. 83 19 866. The inlets and outlets for the exhaust gas are situated at opposite ends. Collection spaces are also formed there, from which the exhaust gas is distributed into the individual tubes of the bundle and flows through it. The inlets and outlets for the exhaust gas are arranged relatively close to the inlets and outlets for the cooling media, so that the flow directions of the exhaust gas and the cooling media intersect in this region.

Such tubular heat exchangers were later abandoned as exhaust gas heat exchangers because they were unsatisfactory in performance and too cumbersome. The bulkiness of the heat exchangers arose, in part, because of the required external housing (mostly in cylindrical shape), which encloses the bundle and borders the flow channels for the coolant on the outside. As a rule, exhaust gas heat exchangers must be very space-saving while simultaneously providing high performance parameters, in particular, for vehicular applications. Round cross-sectional shapes have a lower degree of space utilization, and are thus undesirable.

For these reason, and for cost reasons as well, the switch was made to so-called housingless plate heat exchangers, as shown, for example, in German Utility Patent No. 296 16 354 (which originates from the applicant).

Still another prior art plate-type heat exchanger is shown in European Patent At Application No. 677 715. This plate-type heat exchanger may be adventageously used because the exhaust gas can flow through the heat exchanger without significant diversions that cause pressure losses. However, for a case in which the exhaust gas is cooled with water, the stack of heat exchanger plates is still enclosed by a housing, which leads to the already mentioned shortcomings. The flexibility of the heat exchanger with respect to different connection positions, especially for the coolant connections, is also in need of improvement. The plate stack is designed according to the so-called bar-plate design, so that many individual components are present that must be joined. This can be viewed as costly.

It is therefore an object of the invention to provide a compact, efficient heat exchanger.

It is a further object of the invention to provide a heat exchanger that can be manufactured cost effectively.

It is a still further object of the invention to provide a heat exchanger that exhibits better flexibility with respect to incorporation into space and connection limitations.

SUMMARY OF THE INVENTION

An embodiment of an exhaust gas heat exchanger according to the present invention includes one or two opposite collection spaces for one medium, preferably for the cooling water, which are penetrated by the flow channels for the other medium, i.e., the exhaust gas, leading to very flexible connection possibilities for the inlet and/or outlet connectors, since these can be situated at any sites on the entire periphery of the collection space without requiring significant cost for this reason. If better flexibility of the connection position on the exhaust gas side is desired, it naturally lies within the scope of the invention to exchange the coolant side with the exhaust gas side and to adjust the flow channels accordingly. The passing of the flow channels of one medium through the collection space of the other medium leads to the secondary effect that heat exchange occurs in the collection space itself, which contributes to high efficiency of overall heat exchange.

The requirements of the automotive industry and other users could therefore best be met.

In addition, the housingless design of the exhaust gas heat exchanger provides a compact, space-saving configuration of the heat exchanger. Specifically, the housingless design is achieved in the preponderant region of the heat exchanger, namely where the flow channels run parallel to each other. The heat exchanger according to the invention has flow channels of different lengths. The region just mentioned corresponds roughly to the length of the shorter flow channels.

Plates, which can be rectangular plates or also have a design different from rectangular, are inserted into the flow channels for the exhaust gas. Rectangular plates, on the one hand, ensure good heat transfer without, on the other hand, offering the exhaust gas an opportunity to be deposited and clog the flow channels over time.

The heat exchanger plates have knobs on the coolant side. The knobs of one heat exchanger plate are in contact with the knobs of the next heat exchanger plate, so that they can be joined and contribute to compactness of the heat exchanger. However, it is understood that plates or other turbulence-generating elements can be provided instead of these knobs. Both flow channels are formed by joining the heat exchanger plates, all of which have the same shape, which is very advantageous, in terms of manufacture, and contributes to a cost reduction. The different lengths of the flow channels were also achieved by this type of heat exchanger plate. The heat exchanger plates have edges that are bent to one side over the entire length of the plates, for example, downward with reference to the plane of the plates (back side), and have an edge protrusion over the length of the shorter flow channels, which is designed opposite the bend, i.e., above the plane of the plate (front side). An advantageous variant also has the already mentioned knobs on the same side of the plate (front side). Two heat exchanger plates are placed next to each other with their edges extending over the entire length, i.e., with the back side, and form a flow channel between them. The other flow channel is achieved in that the next heat exchanger plate is positioned front side on front side, whereupon back side on back side follows, and so forth. The inventive idea with shorter and longer flow channels can naturally also be achieved (differently than outlined above) by inserting rods instead of the edge deformations and edge protrusions, which have the length of the shorter flow channels and are joined to the plates. In this case, the plates are preferably only turned back on the opposite longitudinal edges. Two such plates are then nested together and form a flow channel on the inside. The adjacent flow channel is formed by the mentioned rods and bounded on the long sides.

According to the proposed inventive principle, the heat exchanger can be used both with opposite collection spaces for the exhaust gas and/or the coolant and flow-through on a straight path, as in heat exchangers that only have a collection space on one side for the exhaust gas and/or for the coolant and have a deflection space on the opposite end. In this case, as is known, a baffle plate is arranged in the one collection space. Use of this variant improves the flexibility of the connection positions on the exhaust gas side and on the coolant side. Preferably, the outer flow channels are intended for the coolant, because the radiant heat of the heat exchanger can be kept more limited on this account. At exhaust gas temperatures of 700° C. and more, this makes a not insignificant contribution to reducing engine heating, especially in engines in the encapsulated design. In this variant, a sealing plate is situated on and beneath the stack of heat exchanger plates, which bound the coolant channel on the outside. This produces the advantage that connection of the stack of heat exchanger plates with the one tube sheet can be made simpler, because the opening in the tube sheet is designed as a square.

BRIEF DESCRIPTION OF THE DRAWINGS

FIG. 4 is an end view of the exhaust gas heat exchanger of FIG. 1 with the exhaust gas inlet removed to better illustrate the exhaust gas flow passages;

FIG. 5 is an enlarged, cross-sectional view taken along line 5—5 in FIG. 4;

FIG. 6 is an enlarged, cross-sectional view taken along line 6—6 in FIG. 5;

FIG. 7 is an end view of a tube sheet used in the exhaust gas heat exchanger of FIG. 1;

FIG. 8 is an end view of another embodiment of an exhaust gas heat exchanger according to the present invention with the baffle and exhaust gas inlet removed to better illustrate the exhaust gas and coolant fluid flow passages;

FIG. 8A is an enlarged, partial cross-sectional view of the tubes and spacers used in the exhaust gas heat exchanger of FIG. 8;

FIG. 9 is cross-sectional side view of still another embodiment of an exhaust gas heat exchanger according to the present invention;

DETAILED DESCRIPTION OF THE PREFERRED EMBODIMENT

A first embodiment of the water-cooled exhaust gas heat exchanger 1 is shown in FIGS. 1–6 and 9–12. The exhaust gas heat exchanger 1 is made of an appropriate material, such as a steel. All connections between parts are produced by brazing or some other suitable joining method.

Figure 1:
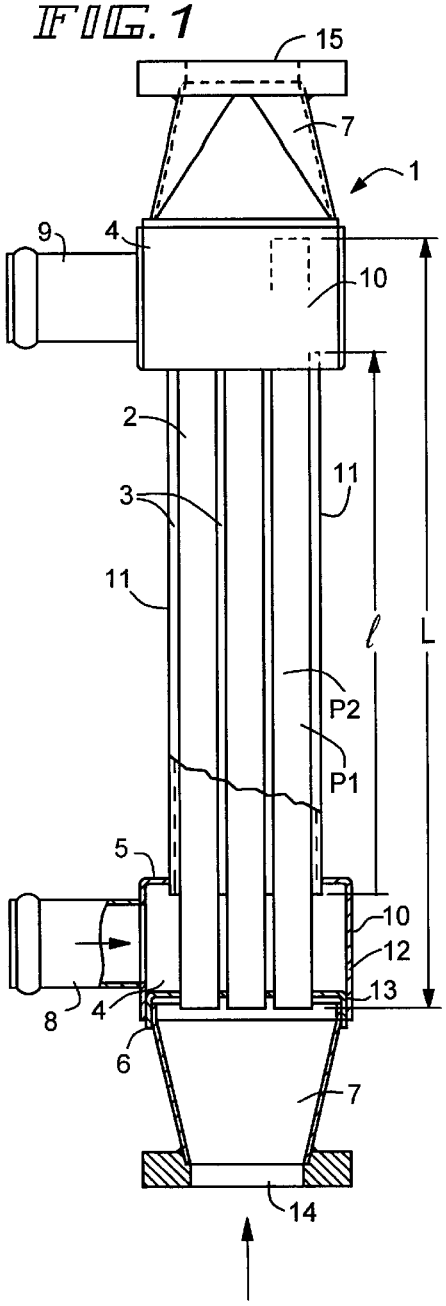
FIG. 1 is side view in partial cross-section of an exhaust gas heat exchanger according to an embodiment of the present invention.
Figure 2:
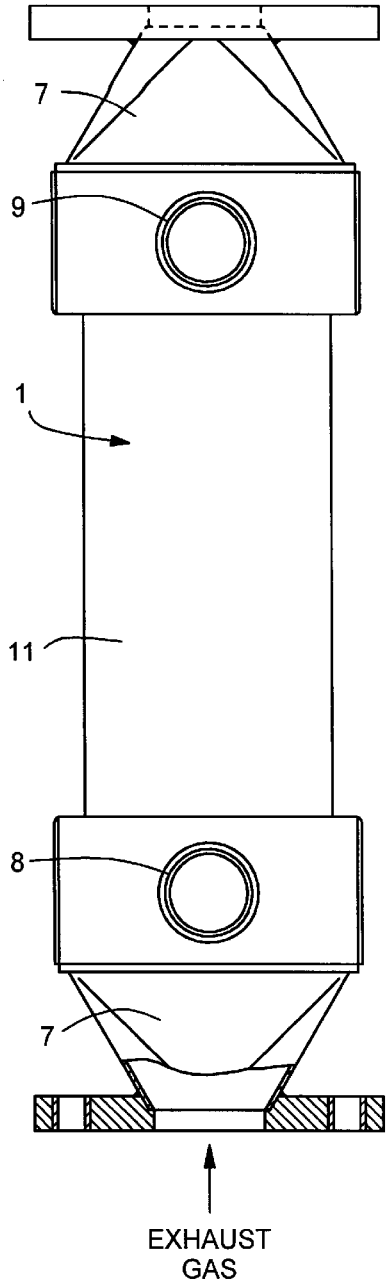
FIG. 2 is a top view in partial cross-section of the exhaust gas heat exchanger of FIG. 1.

The left collection space 4 for the cooling water and the collection space 7 for the exhaust gas were drawn in FIG. 1 in section to show the details. The exhaust gas flows through inlet 14 into collection space 7 and via flow channels 2 along a straight path through heat exchanger 1, to leave this again via outlet 15. The inlets and outlets 14, 15 have appropriate connections that were depicted simply here as connection flanges. The cooling water flows at inlet 8 into collection space 4 and is distributed to the flow channels 3, which run parallel to flow channels 2 and alternate with them. The collection spaces 4 are formed from the tube sheets 5 and 6, in which the jacket 5 of collection space 4 was produced in this practical example by the aligned edge 12 of tube sheet 5, which forms a connection surface 13 with the edge of tube sheet 6.

The stack, consisting of identical heat exchanger plates P1 and P2, has shorter flow channels 3 and longer flow channels 2, which is explained in greater detail below. The different lengths L and 1 of flow channels 2 and 3 was marked in FIG. 1. The longer flow channels 2 pass through the collection spaces 4 and are sealed in the opening 17 of the second tube sheet 6 (see also FIG. 4, in which three openings 17 for the three flow channels 2 are shown).

Figure 3:
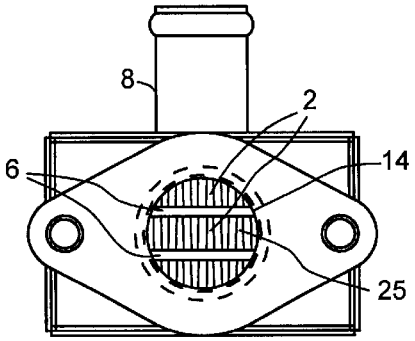
FIG. 3 is an end view of the exhaust gas heat exchanger of FIG. 1.
Figure 10:
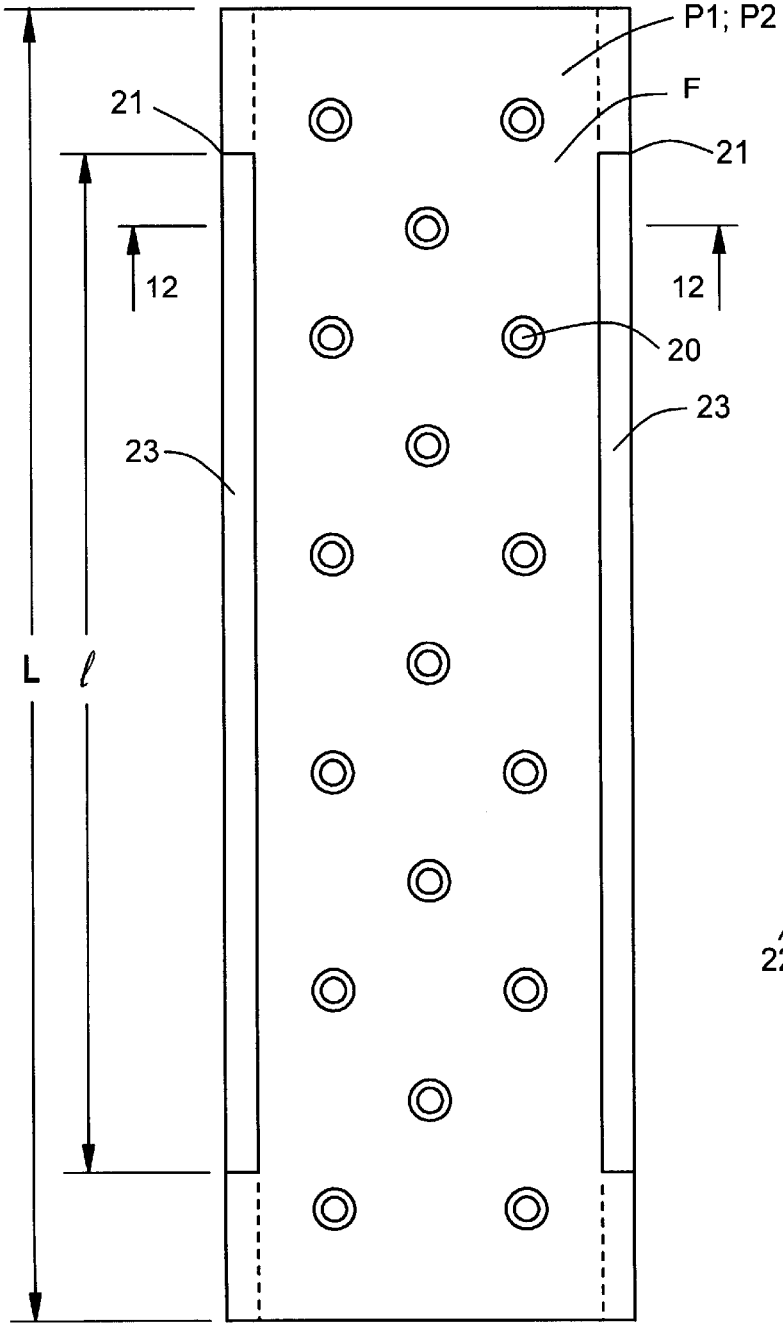
FIG. 10 is a top view of a heat exchanger plate used in the exhaust gas heat exchanger of FIG. 1.
Figure 12:
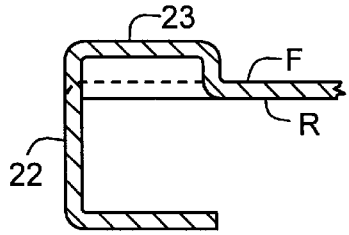
FIG. 12 is a enlarged, partial cross-sectional view of the heat exchanger plate of FIG. 10 taken along line 12—12.
Figure 11:
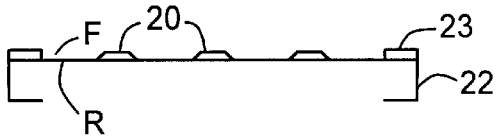
FIG. 11 is an end view of the heat exchanger plate of FIG. 10.

FIG. 4 and also FIG. 3 additionally show that rectangular plates 25 are inserted into flow channels 2, in order to improve heat exchange. The plates 25 are connected to heat exchanger plates P1 and P2 or to the walls of flow channels 2.

The tube sheet 5 has only one opening 16, as shown in FIG. 7. The opening 16 is a rectangle. FIG. 6 shows, in an enlarged section, attachment of the heat exchanger plates P1 and P2 in this opening 16. A sealing plate 11 was drawn on the upper edge of opening 16. An identical plate 11 is situated on the lower edge (not shown) of opening 16. The sealing plates 11 cover the heat exchanger plates P1, P2 fully (FIG. 2) and border the upper and lower flow channel 3, which is provided for cooling water. In this practical example, identical heat exchanger plates P1 and P2 were used, which were shown in FIGS. 10–12. The heat exchanger plates P1, P2 are rectangular here and, consequently, have two opposite long edges 21. A deformation 22 extending over the entire plate length L is situated on these long edges 21 and is directed toward the back side R of the plane of the plate. On the front side F, the heat exchanger plates P1 and P2 have an edge protrusion 23 on the two long edges 21, which extends only over length 1 of the heat exchanger plates P1 and P2. It is apparent, in connection with FIG. 6, that two heat exchanger plates P1 and P2 are positioned next to each other with their back sides R and form flow channel 2 on the inside, which extends over the entire length L. The heat exchanger plates P1 and P2 are connected on their edge deformations 22. On the front side F of heat exchanger plate P1 or P2, the next heat exchanger plate P1 or P2 is situated, which was also arranged with the front side F, in which heat exchanger plates P1, P2 are joined with their edge protrusions 23 and form flow channels 3. Knobs 20 extend into these flow channels 3 in this practical example. The knobs 20 have the same height as the edge protrusions 23 and are otherwise arranged so that they are in contact with the knobs 20 on the adjacent heat exchanger plate P1 or P2, in order to be connected.

An another embodiment of an exhaust gas heat exchanger according to the present invention is shown in FIG. 8. In the embodiment shown in FIG. 8, the edge 21 of heat exchanger plates P1 and P2 was simply bent back over the entire length L, so that the heat exchanger plates P1 and P2 can be nested into each other to form flow channels 2. A bar 24, having twice the height of knobs 20, lies between these flow channels 2 on both edges 21. The length of bar 24 corresponds to length 1, so that the flow channels 3 can be formed in this fashion.

Still another embodiment of an exhaust gas heat exchanger according to the present invention is shown in FIG. 9. FIG. 9 makes it clear that, with respect to flow through the heat exchanger, all possible variants can be implemented, in which the proposed basic principle is not abandoned. A partition 19 is situated in the collection space 7 for exhaust gas. The inlet 14 and outlet 15 are arranged on this collection space 7, so that the exhaust gas can flow via two flow channels 3 into the deflection collection space 18 arranged on the opposite side and, after deflection, can go back to outlet 15 via the other two flow channels 3.

Other unillustrated embodiments of an exhaust gas heat exchanger according to the present invention include an exhaust gas heat exchanger wherein the cooling water outlet 9 is located on the lower collection space 4, a baffle is inserted in collection space 4, and a comparable deflection collection space for the cooling water on the opposite end. Further, the inlet and outlet for the coolant may be on one side of the heat exchanger, and the inlet and outlet for the exhaust gas may be on the opposite side of the heat exchanger.

Still other aspects, applications, objects, and advantages of the present invention can be obtained from a study of the specification, the drawings, and the appended claims.

We claim:

1. A heat exchanger such as an exhaust gas heat exchanger comprising a stack of heat exchanger plates that form separate flow channels that run parallel to each other, with collection spaces, inlets and outlets for exhaust gas and for a coolant and characterized by the flow channels being formed from heat exchanger plates which, for one medium, are longer than the flow channels for the other medium and pass through at least one collection space for said other medium having the inlet and/or outlet; in that the region in which both flow channels run parallel to each other, the heat exchanger is designed without a housing; in that the collection space is bounded by two opposite tube sheets and enclosed by a jacket on which the inlet and/or outlet is situated; in that the jacket is formed by the edge of one tube sheet which forms a connection surface with the edge of the other tube sheet and by the outer channels being exhaust gas channels in which one tube sheet has an opening that has a cut-out in the corners for edge protrusions of the uppermost and lowermost heat exchanger plate in order to accommodate the entire stack of heat exchanger plates.

* * * * *